US008272726B2

(12) United States Patent
Hyakudome et al.

(10) Patent No.: US 8,272,726 B2
(45) Date of Patent: Sep. 25, 2012

(54) INKJET HEAD AND PRINTING APPARATUS

(75) Inventors: Takao Hyakudome, Nagoya (JP); Kenji Hirata, Nagoya (JP); Akira Nishio, Kiyosu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 339 days.

(21) Appl. No.: 12/591,927

(22) Filed: Dec. 4, 2009

(65) Prior Publication Data

US 2010/0188467 A1 Jul. 29, 2010

(30) Foreign Application Priority Data

Jan. 29, 2009 (JP) ..... 2009-018863

(51) Int. Cl.
*B41J 2/175* (2006.01)

(52) U.S. Cl. ..... 347/87
(58) Field of Classification Search ..... 347/85, 347/86; 345/87
See application file for complete search history.

(56) References Cited

U.S. PATENT DOCUMENTS

| | | | | |
|---|---|---|---|---|
| 5,138,332 | A | 8/1992 | Carlotta | |
| 5,742,312 | A * | 4/1998 | Carlotta | 347/87 |
| 6,145,974 | A | 11/2000 | Shinada et al. | |
| 6,257,712 | B1 | 7/2001 | Haigo | |
| 6,722,761 | B2 * | 4/2004 | Asano et al. | 347/85 |
| 6,796,643 | B2 * | 9/2004 | Higuma et al. | 347/85 |
| 7,264,342 | B2 * | 9/2007 | Yamamoto et al. | 347/86 |
| 7,360,877 | B2 | 4/2008 | Ikezaki et al. | |
| 7,445,323 | B2 * | 11/2008 | Anderson et al. | 347/86 |
| 2005/0036017 | A1 | 2/2005 | Chikamoto et al. | |
| 2008/0174645 | A1 | 7/2008 | Umeda et al. | |
| 2011/0069126 | A1 | 3/2011 | Feng et al. | |

FOREIGN PATENT DOCUMENTS

| | | | |
|---|---|---|---|
| EP | 0 737 584 | A2 | 10/1996 |
| EP | 1 016 533 | A1 | 7/2000 |
| EP | 1 535 743 | A1 | 6/2005 |
| EP | 1 602 488 | A2 | 12/2005 |
| GB | 2 293 142 | A | 3/1996 |
| JP | B-63-044046 | | 9/1988 |
| JP | A-04-273020 | | 9/1992 |
| JP | A-11-198393 | | 7/1999 |
| JP | A-2004-291297 | | 10/2004 |
| JP | A-2005-161854 | | 6/2005 |

OTHER PUBLICATIONS

European Search Report issued in European Patent Application No. 09 17 9612 on Apr. 8, 2010.
Jun. 12, 2012 Office Action issued in JP Application No. 2009-018863 (with English translation).

* cited by examiner

*Primary Examiner* — Anh T. N. Vo
(74) *Attorney, Agent, or Firm* — Oliff & Berridge, PC

(57) ABSTRACT

An inkjet head is provided. The inkjet head includes an ink reservoir to store ink, an ink inlet, through which the ink is introduced to the ink reservoir, an ink outlet, through which the ink in the ink reservoir is allowed to flow to the inkjet nozzle. The ink reservoir has a wall arising from a bottom of the ink reservoir to divide the ink reservoir into a plurality of ink chambers. The plurality of ink chambers include a first ink chamber and a second ink chamber. The plurality of ink chambers are in fluid communication with each other over a top edge of the wall. The wall is formed to include a through hole, which is formed in a vicinity of the bottom of the ink reservoir and allows the plurality of ink chambers to be in fluid communication with each other.

21 Claims, 13 Drawing Sheets

INKJET HEAD AND PRINTING APPARATUS

CROSS REFERENCE TO RELATED APPLICATION

This application claims priority from Japanese Patent Application No. 2009-018863, filed on Jan. 29, 2009, the entire subject matter of which is incorporated herein by reference.

BACKGROUND

1. Technical Field

An aspect of the present invention relates to an inkjet head to eject ink onto a recording medium and a printing apparatus having the inkjet head.

2. Related Art

Conventionally, an inkjet printer to eject inks onto a recording medium, such as a piece of paper and fabric (e.g., a T-shirt), to print an image has been known. The inks to be used in the inkjet printer may include various colors, which are for example white, black, cyan, magenta, and yellow. The inks include water or other organic solvent, colorants, and occasionally, emulsion adhesive. The inkjet printer is equipped with an inkjet head to eject ink onto the recording medium and a carriage to carry the ink-ejecting inkjet head during a printing operation. The inkjet head is generally provided with an ink storage, in which the ink is stored. The inkjet head is mounted on the carriage and reciprocated along with the carriage in a direction perpendicular to a feeding direction of the recording medium. In many cases, the ink storage is connected to an ink container by a tube.

The ink storage may be equipped with a partition wall, which arises upward from a bottom of the ink storage. Within such an ink storage, the partition wall extends in a direction perpendicular to the reciprocating direction of the carriage. The partition wall divides inner space of the ink storage in two rooms, one of which is provided with an ink inlet and the other of which is provided with an ink outlet. The partition wall serves to reduce bubbling in the ink, which may occur when the ink in the ink storage being carried is ruffled. When the bubbling is reduced, the bubbles which may cause irregular ejection of the ink can be prevented. Thus, the ink can be smoothly and evenly ejected from the inkjet head, and qualities of a printed image can be improved.

When the carriage is reciprocated and the ink moves in the tube, pressures in the ink container fluctuate. The fluctuation of the pressures can cause uneven ejection of the ink. Therefore, in order to reduce the pressure fluctuation, the partition wall is formed to have a pressure absorbable flexible layer, which is made of, for example, resin. Such a functionality of the flexible layer is referred to as damper performance.

SUMMARY

The inkjet printer may use white ink, which contains oxidized titanium and therefore has higher specific gravity of colorant with respect to gravities of colorants in the other colored inks. When the white ink is used, however, the colorant may deposit and remain at the bottom of the first ink room with the partition wall. The remaining ink can undesirably occupy the first room and may block the flow of the ink into the second room. Further, a usable area of the pressure-absorbable surface of the flexible layer can be occupied by the deposited ink inefficiently and not used to absorb the pressure fluctuation by the flowing ink. Thus, the damper performance is lowered, and the ink may not be ejected evenly.

In view of the above drawbacks, the present invention is advantageous in that an inkjet head, capable of preventing the colorant from accumulating in the ink storage so that uneven ejection of the ink can be prevented, is provided. Further, an inkjet printer having the inkjet head is provided.

According to an aspect of the present invention, an inkjet head having an ink nozzle capable of ejecting ink onto a recording medium is provided. The inkjet head includes an ink reservoir to store the ink to be ejected therein, an ink inlet, through which the ink is introduced to the ink reservoir, an ink outlet, through which the ink in the ink reservoir is allowed to flow to the inkjet nozzle. The ink reservoir has a wall arising from a bottom of the ink reservoir to divide the ink reservoir into a plurality of ink chambers, the plurality of ink chambers including a first ink chamber and a second ink chamber. The plurality of ink chambers are in fluid communication with each other over a top edge of the wall. The ink inlet introduces the ink into the first ink chamber. The ink outlet discharges the ink in the second ink chamber to the ink nozzle. The wall is formed to include a through hole, which is formed in a vicinity of the bottom of the ink reservoir and allows the plurality of ink chambers to be in fluid communication with each other.

According to another aspect of the present invention, an inkjet printing apparatus having an inkjet head with an ink nozzle capable of ejecting ink onto a recording medium is provided. The inkjet head includes an ink reservoir to store the ink to be ejected therein, an ink inlet, through which the ink is introduced to the ink reservoir, an ink outlet, through which the ink in the ink reservoir is allowed to flow to the inkjet nozzle. The ink reservoir includes a wall arising from a bottom of the ink reservoir to divide the ink reservoir into a plurality of ink chambers, the plurality of ink chambers including a first ink chamber and a second ink chamber. The plurality of ink chambers are in fluid communication with each other over a top edge of the wall. The ink inlet introduces the ink into the first ink chamber. The ink outlet discharges the ink in the second ink chamber to the ink nozzle. The wall is formed to include a through hole, which is formed in a vicinity of the bottom of the ink reservoir and allows the plurality of ink chambers to be in fluid communication with each other.

BRIEF DESCRIPTION OF THE ACCOMPANYING DRAWINGS

Figure 3:
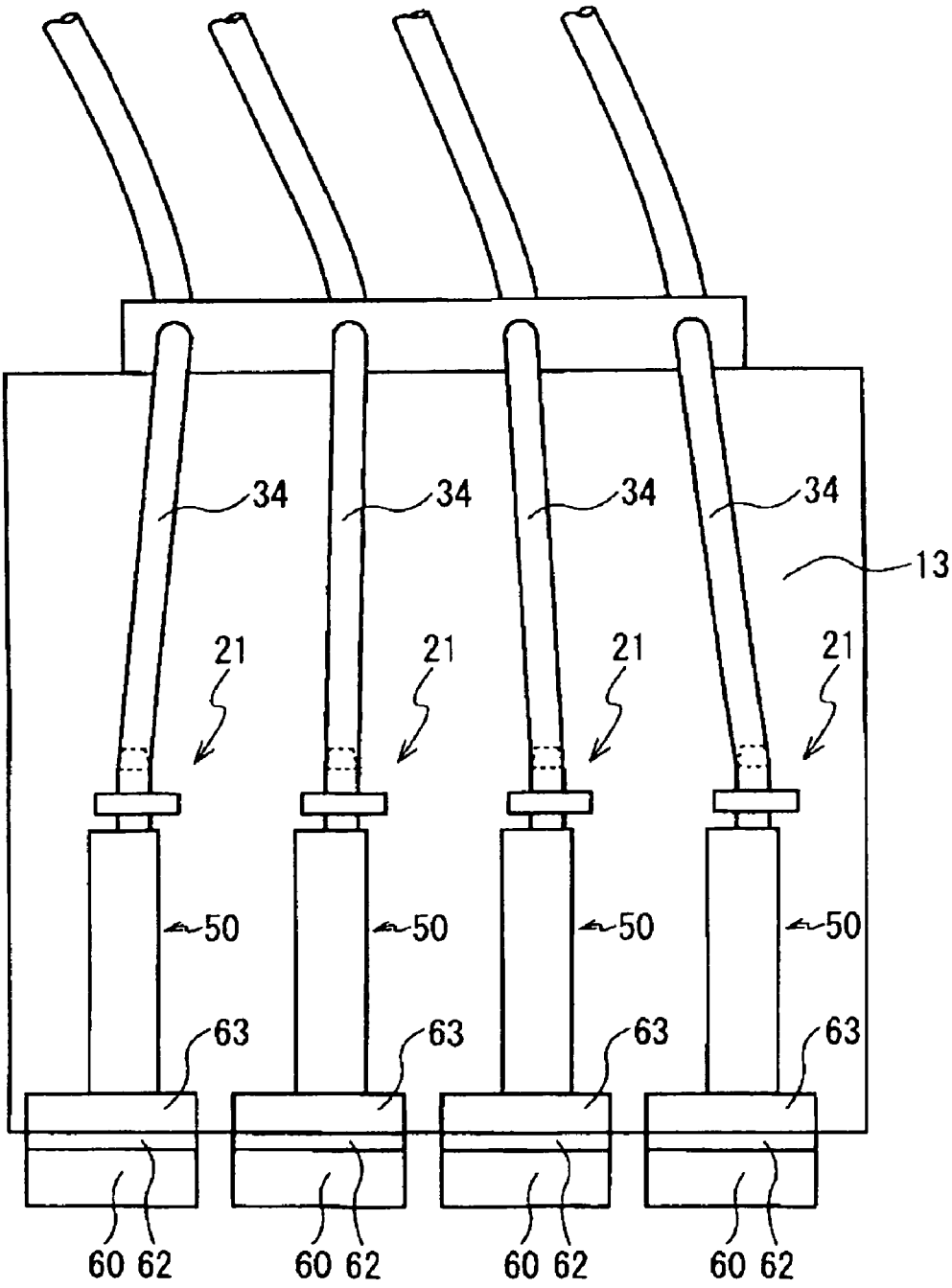

FIG. 3 is a front view of first recording heads 21 and ink conveyer tubes 34 in the inkjet printer 1 according to the first embodiment of the present invention.

Figure 4:
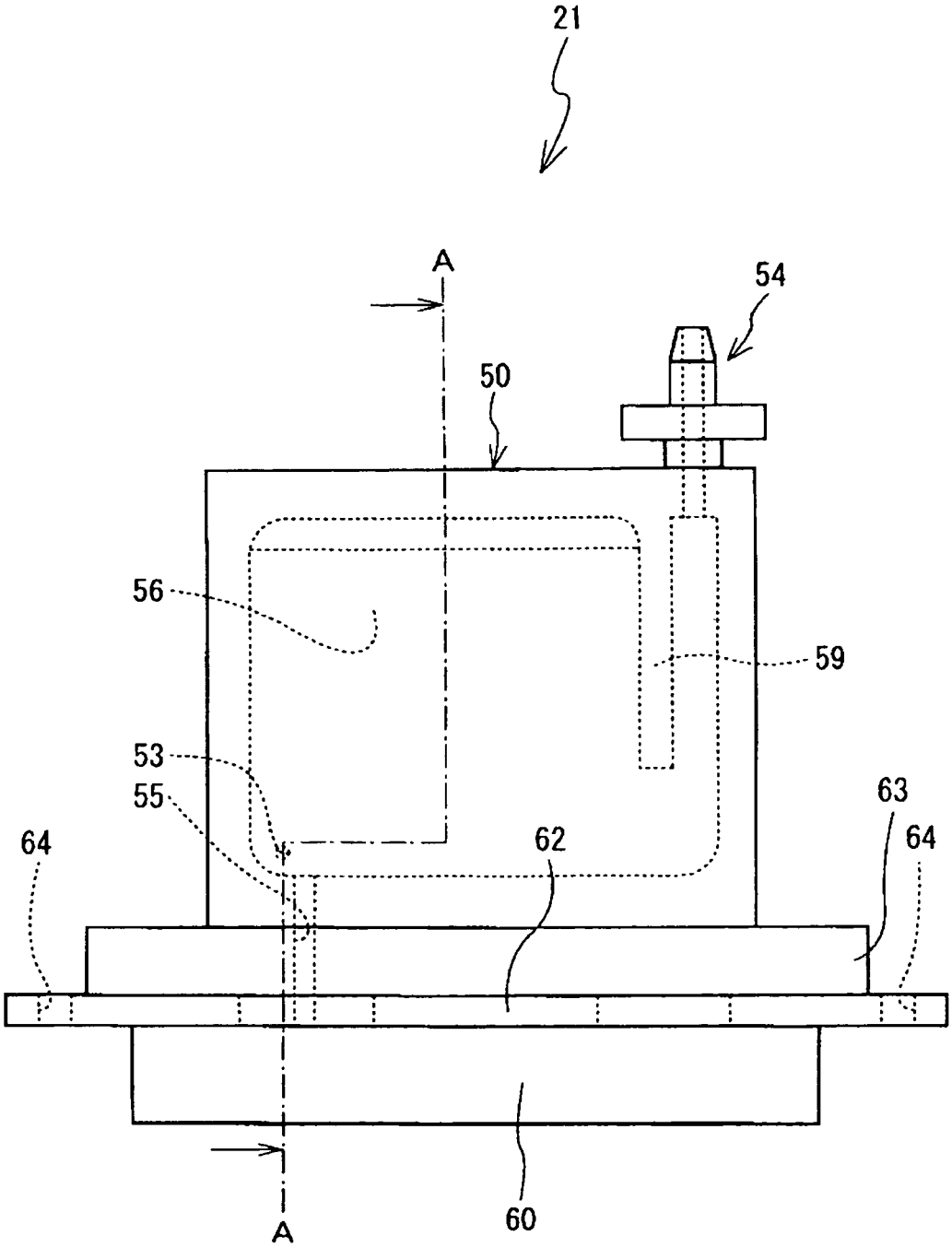

FIG. 4 is a side view of the first inkjet head 21 according to the first embodiment of the present invention.

Figure 5:
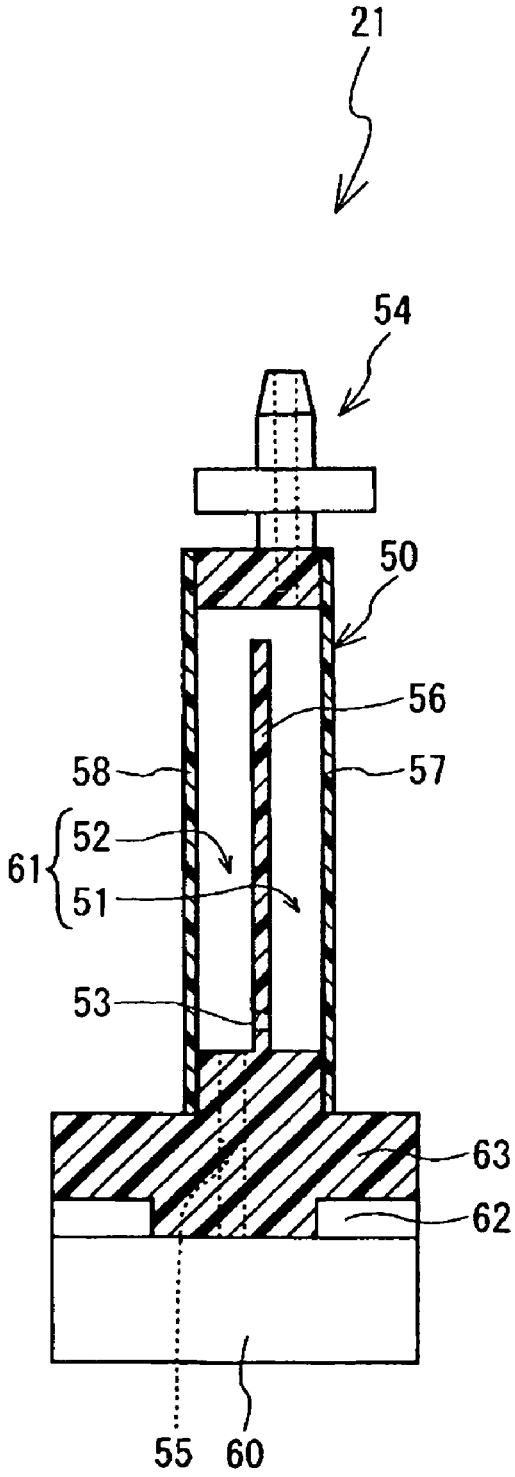

FIG. 5 is a cross-sectional view of the first inkjet head 21, taken at a line A-A indicated in FIG. 4, according to the first embodiment of the present invention.

Figure 6:
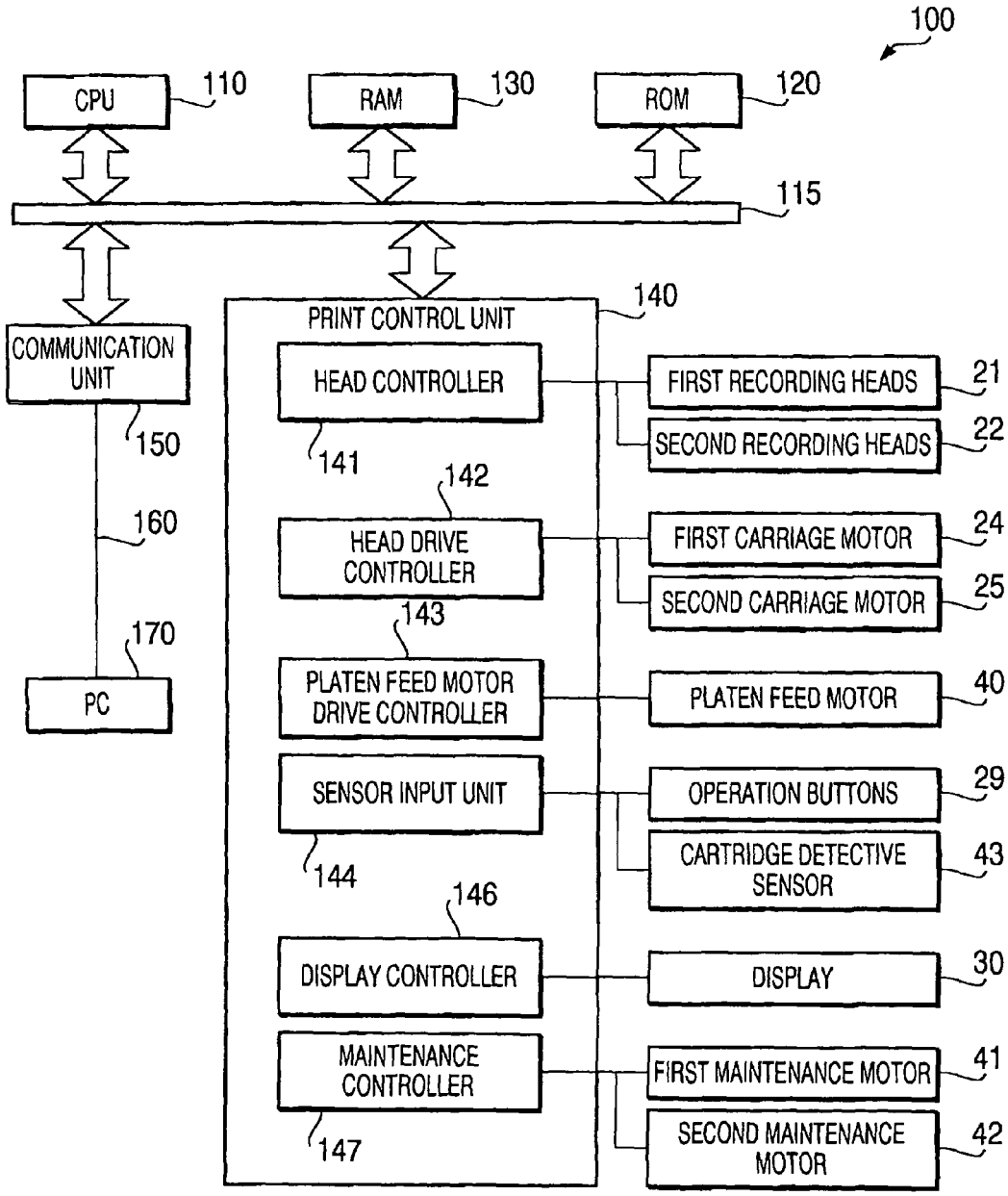

FIG. 6 is a block diagram to illustrate an electric configuration of the inkjet printer 1 according to the first embodiment of the present invention.

Figure 7:
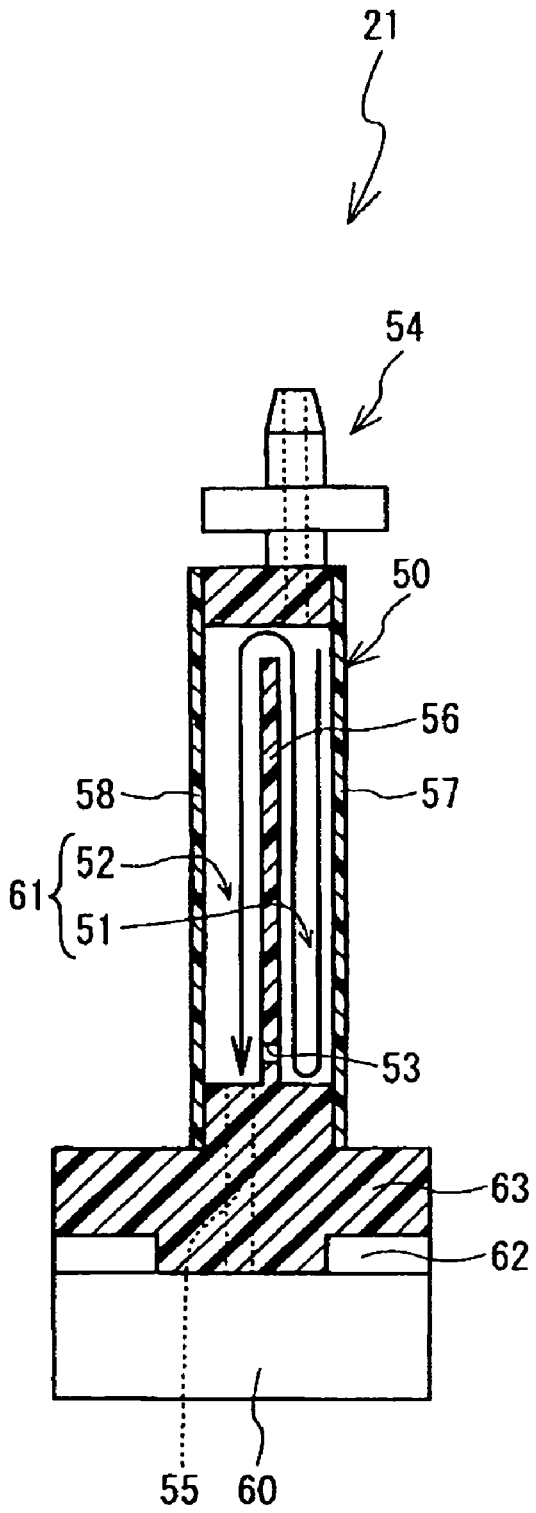

FIG. 7 is a cross-sectional view of the first inkjet head 21, taken at the line A-A, with a flow of the ink illustrated, according to the first embodiment of the present invention.

Figure 8:
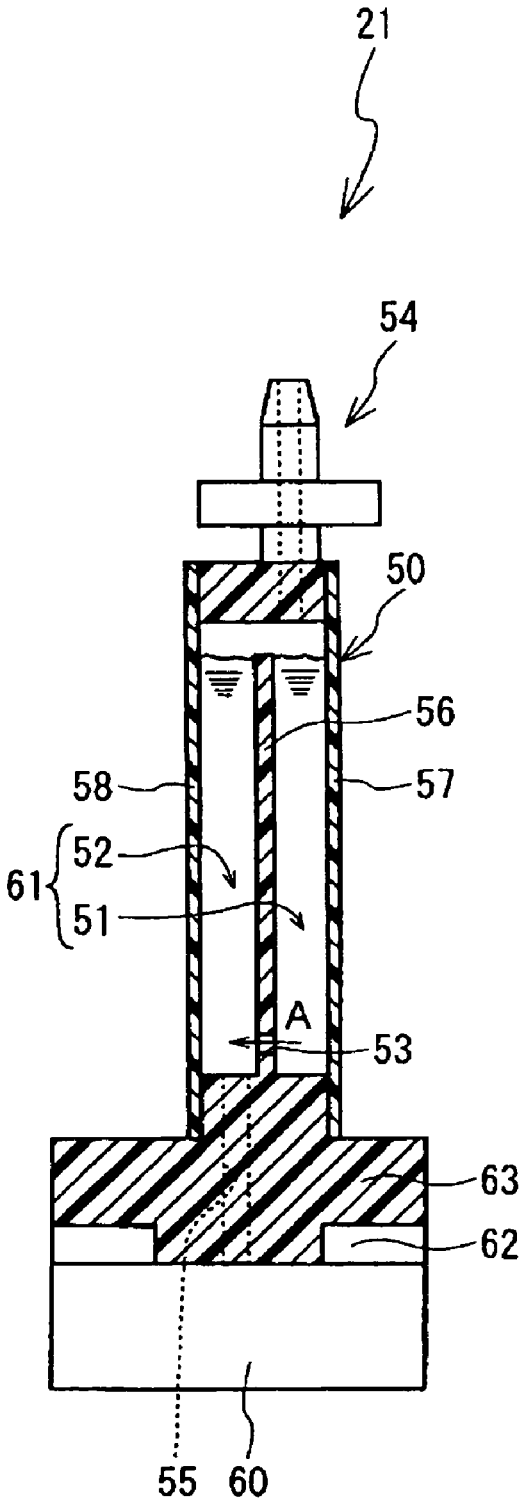

FIG. 8 is a cross-sectional view of the first inkjet head 21, taken at the line A-A, with a first ink chamber 51 and a second ink chamber 52 filled with ink, according to the first embodiment of the present invention.

Figure 9:
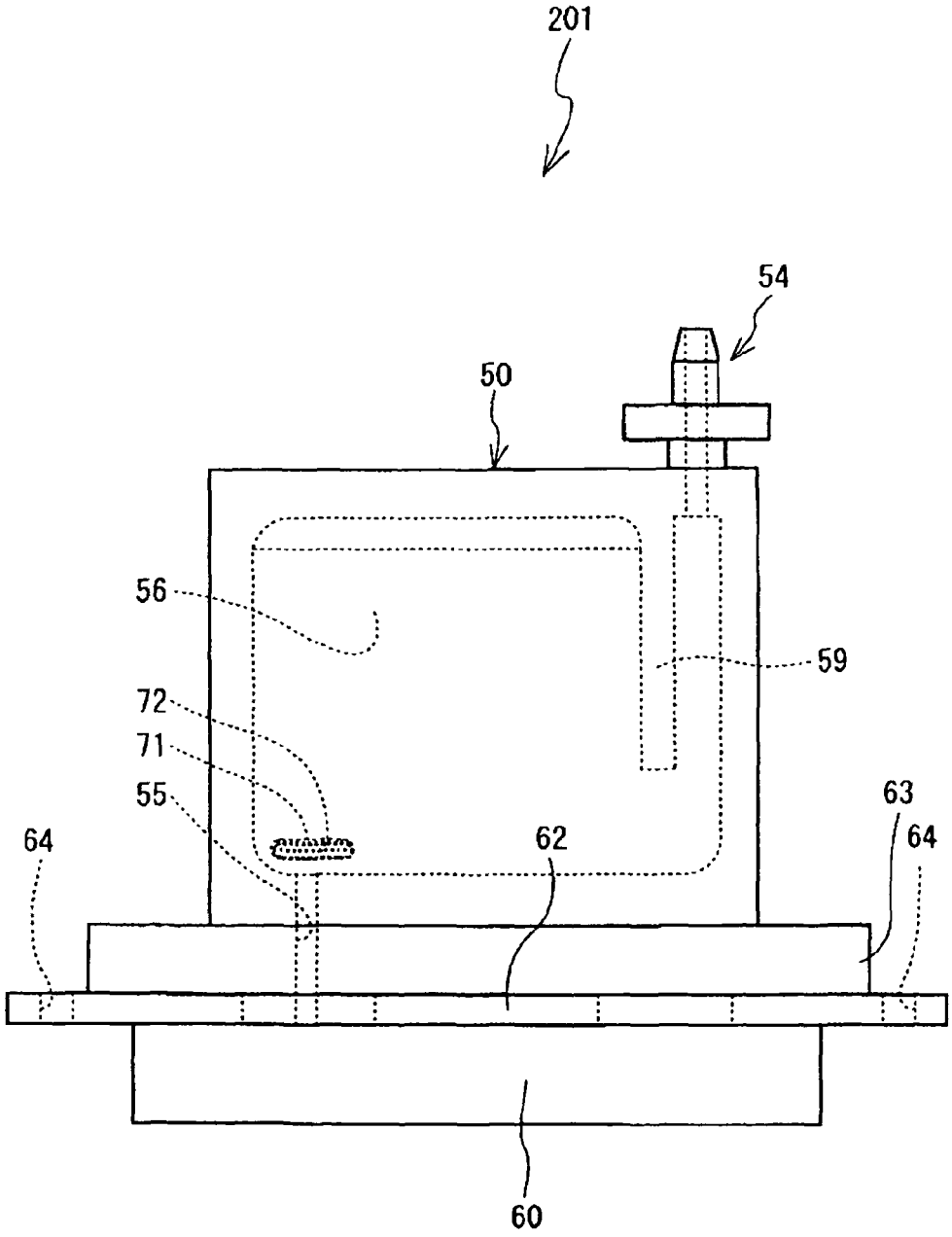

FIG. 9 is a side view of an inkjet head 201 with an elongated through hole 71 and a filter 72 according to a second embodiment of the present invention.

Figure 10:
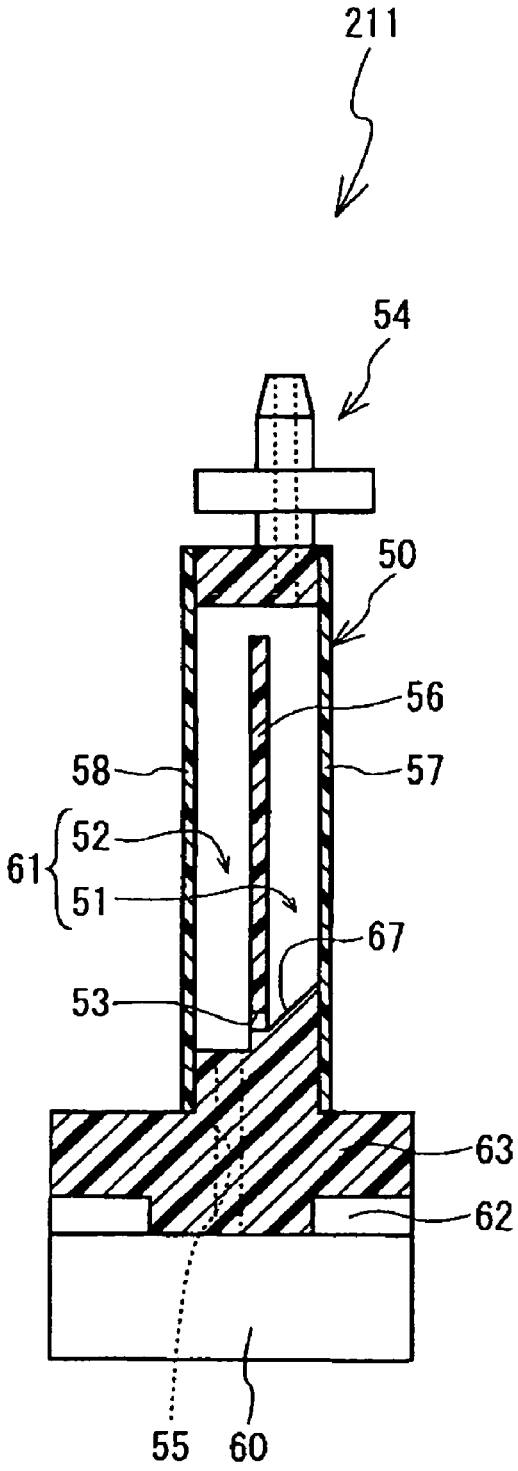

FIG. 10 is a cross-sectional view of the inkjet head 201 with a declined bottom surface 67 according to the second embodiment of the present invention.

Figure 11:
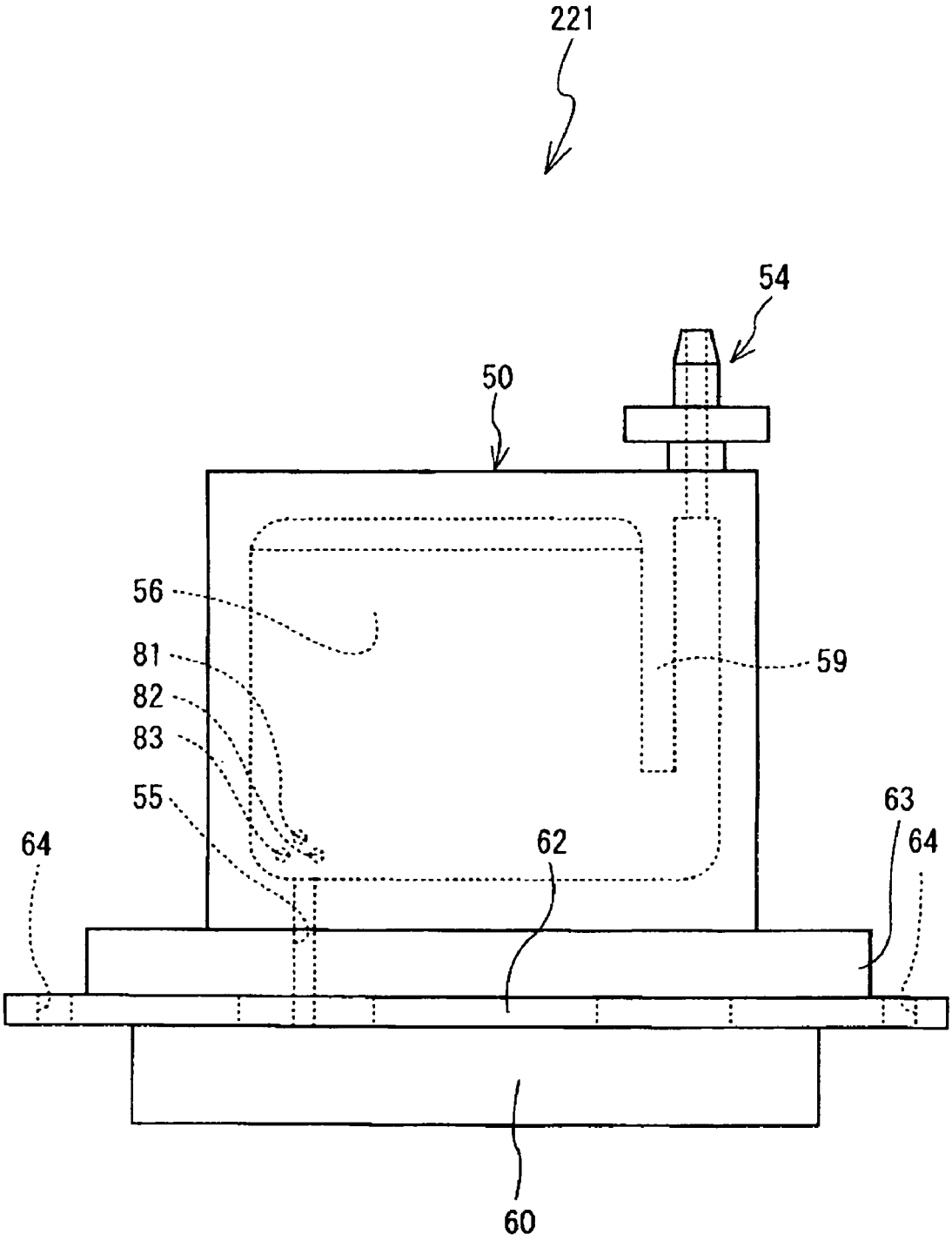

FIG. 11 is a side view of an inkjet head 211 with a plurality of through holes 81-83 in according to a third embodiment of the present invention.

Figure 12:
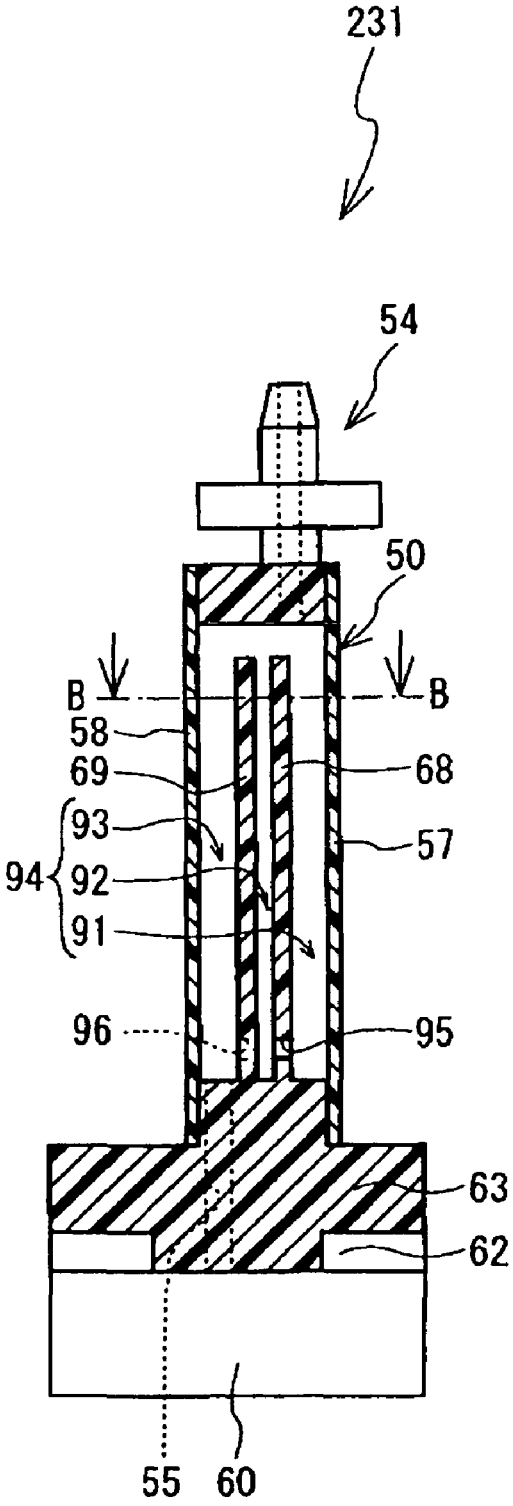

FIG. 12 is a cross-sectional view of an inkjet head 231 with walls 68, 69 according to a fourth embodiment of the present invention.

Figure 13:
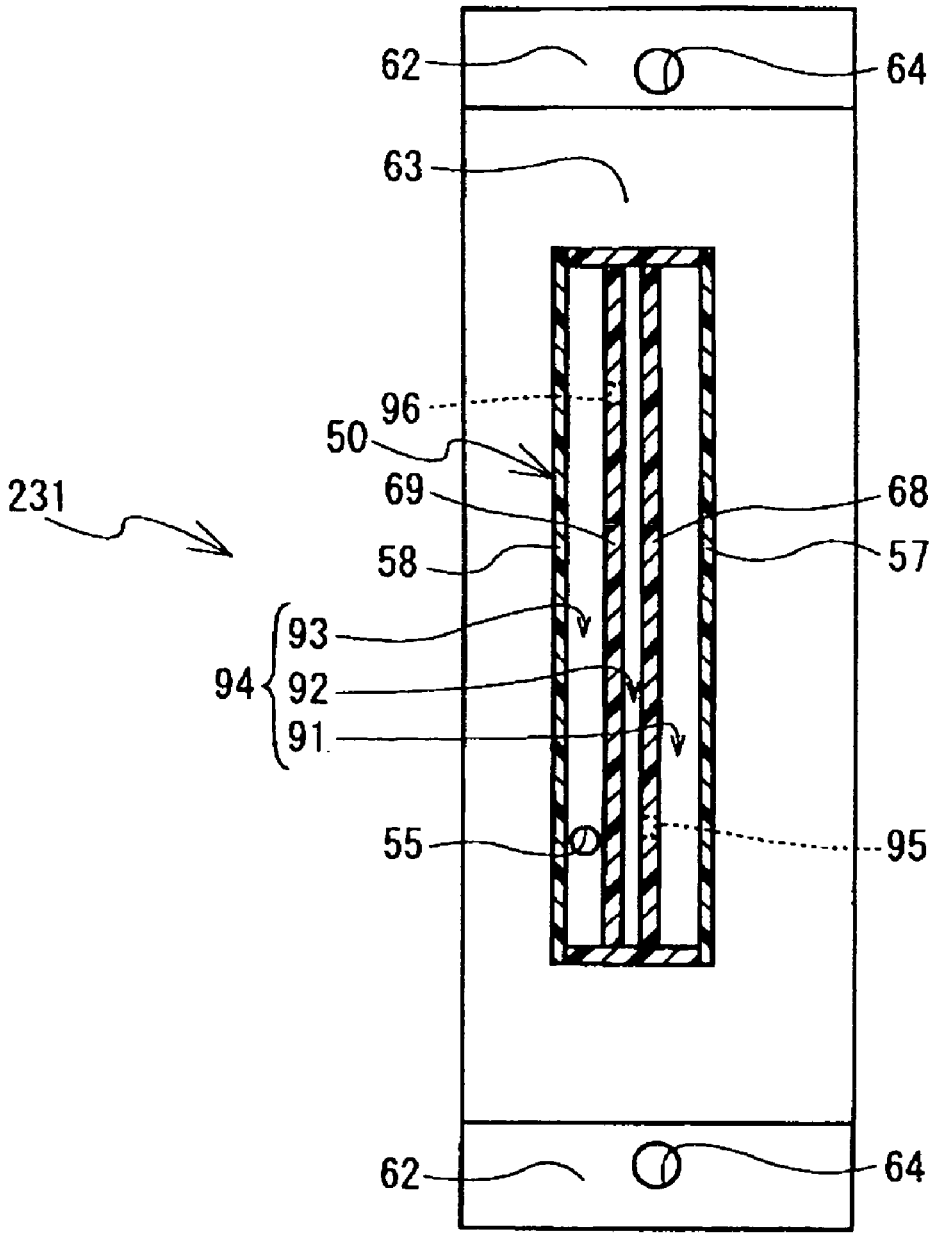

FIG. 13 is a cross-sectional view of the inkjet head 231, taken at a line B-B indicated in FIG. 12, according to the fourth embodiment of the present invention.

DETAILED DESCRIPTION

Hereinafter, embodiments according to the present invention will be described with reference to the accompanying drawings. Firstly, a configuration of an inkjet printer 1 according to the present embodiment will be described with reference to FIGS. 1 though 3. In the description herein, a lower side, an upper side, a left-hand side, and a right-hand side in FIG. 1 correspond to frontward, rearward, leftward, and rightward of the inkjet printer 1 respectively. Further, an upper side and a lower side in FIG. 2 correspond to upward and downward of the inkjet printer 1 respectively.

Figure 1:
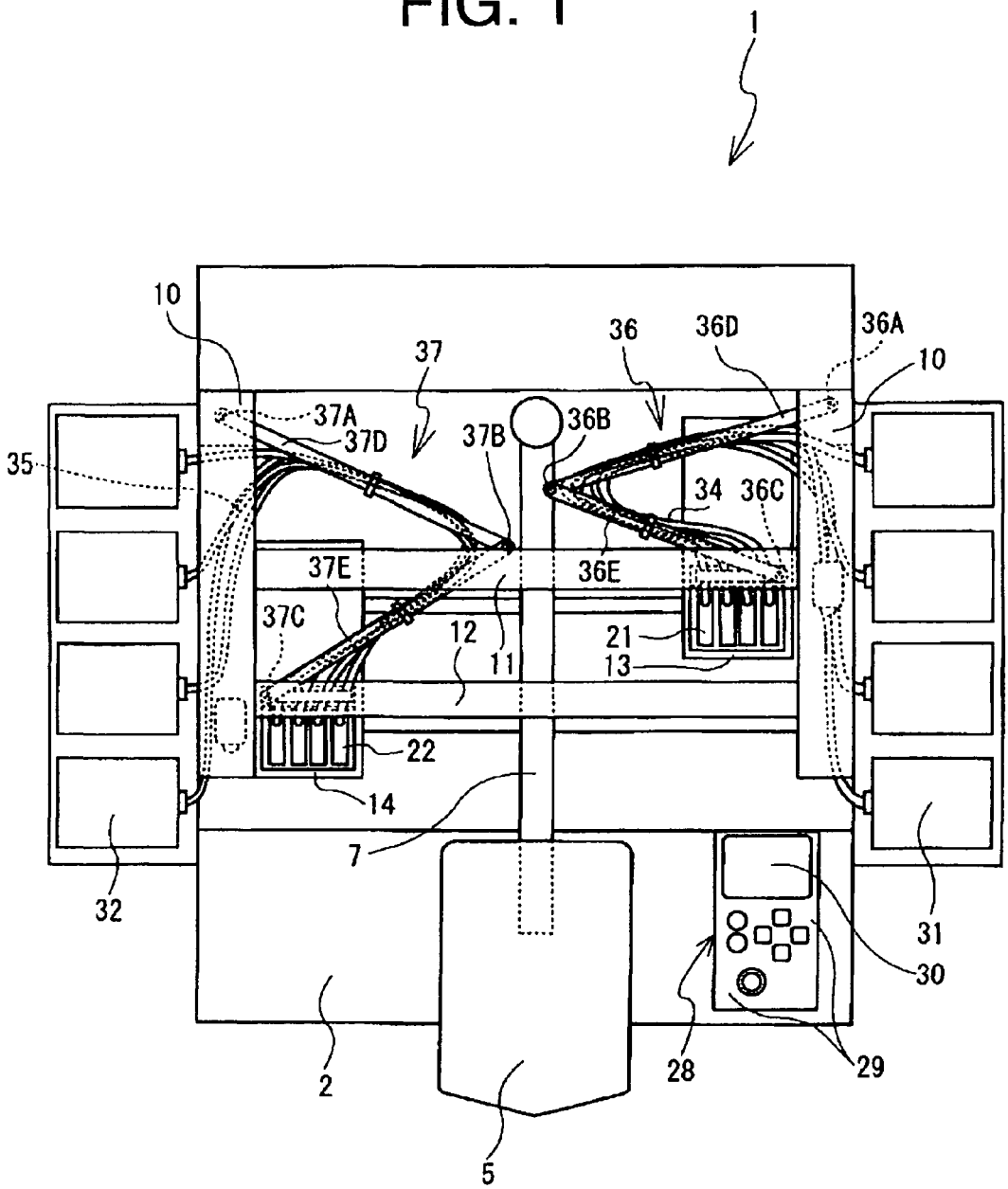
FIG. 1 is a plane view of an inkjet printer 1 according to a first embodiment of the present invention.
Figure 2:
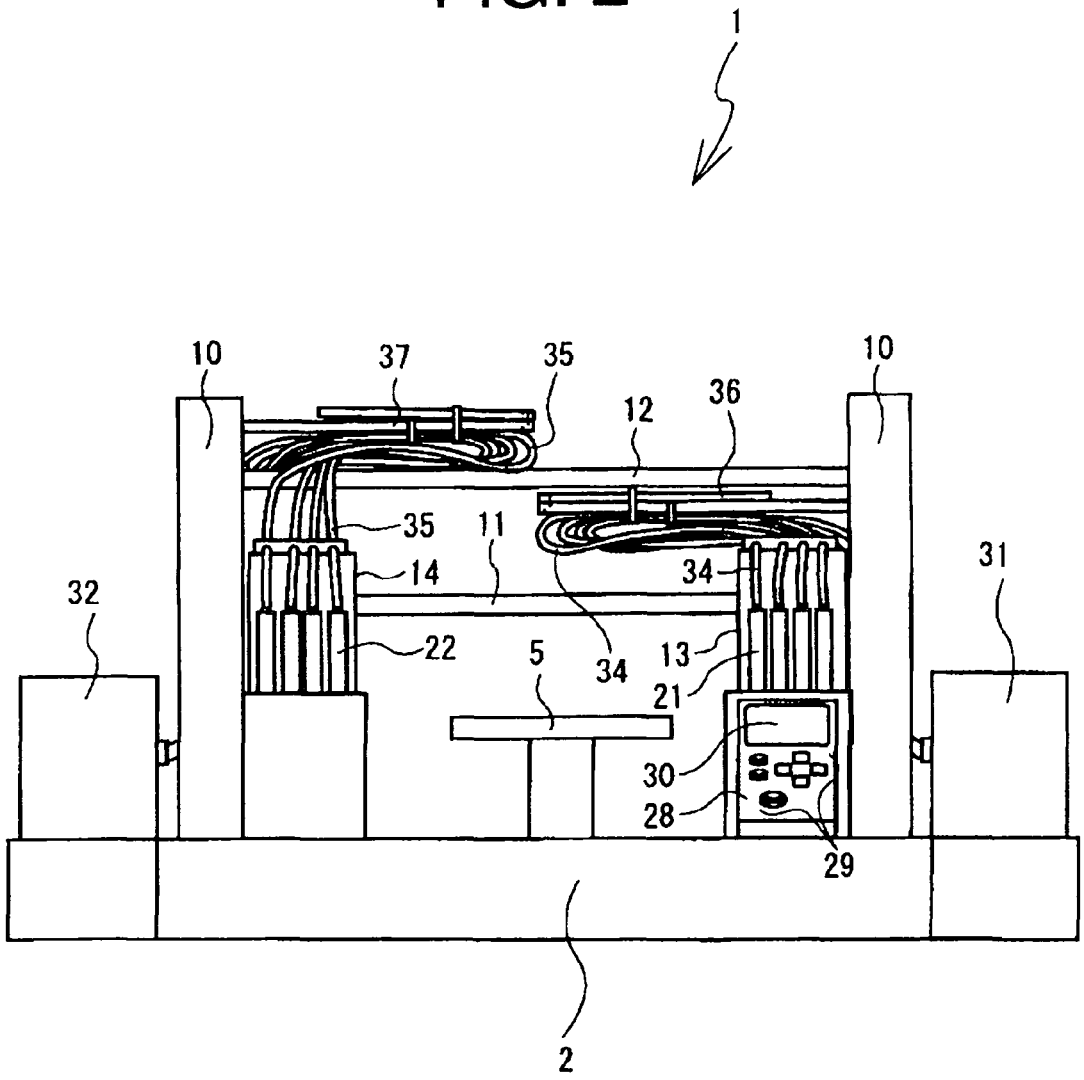
FIG. 2 is a front view of the inkjet printer 1 according to the first embodiment of the present invention.

The inkjet printer 1 is a known inkjet printer, for printing an image on a piece of fabric in an inkjet method. As shown in FIGS. 1 and 2, the inkjet printer 1 is provided with a flat base plate 2 at a bottom and a chassis 10 to cover the entire body of the inkjet printer 1. The inkjet printer 1 is provided with a guide rail 7, which extends in the front-rear direction of the inkjet printer 1 at an approximate center in the left-right direction of the base plate 2, and a platen feed motor 40 (FIG. 6) being a stepping motor arranged at a rear end portion (i.e., the upper end) of the guide rail 7. The guide rail 7 supports an exchangeable platen 5, which is a flat plate and detachable from the guide rail 7. When the platen feed motor 40 is activated, the platen 5 is reciprocated along the guide rail 7 in the up-and-down direction in FIG. 1. The platen 5 is a substantially rectangular-shaped flat plate with a shorter side facing an operator excurved. The recording medium (e.g., a T-shirt) is placed in a printable posture in the inkjet printer 1. The inkjet printer 1 may have a plurality of sizes of platen 5, which can be selected according to, for example, sizes and shapes of the recording media.

The inkjet printer 1 has first recording heads 21 and second recording heads 22 to form an image on the recording medium in inks ejected from nozzle surfaces of the first and the second recording heads 21, 22 according to image data. The first recording heads 21 are mounted on a carriage 13, which is reciprocated in the right-and-left direction in FIG. 1 along a guide rail 11. In the vicinity of the right-hand end of the guide rail 11, a first carriage motor 24 (FIG. 6) to carry the first inkjet heads 21 is provided. Further, a pulley (not shown) is provided in the vicinity of the left-hand end of the guide rail 11, and a carriage belt (not shown) is drawn between the first carriage motor 24 and the pulley. The carriage belt is fixed to a rear side of the carriage 13. The carriage 13 is slidably connected to the guide rail 11 and reciprocated along the guide rail 11 in the right-and-left direction (i.e., a main scanning direction) when the first carriage motor 24 is activated.

On the right-hand end of the chassis 10, first ink cartridges 31 containing white ink therein are detachably attached. The first ink cartridges 31 are connected to each of the inkjet heads 21 by flexible ink conveyer tubes 34 so that the inks stored in the first ink cartridges 31 are conveyed to each channel of the inkjet heads 21. According to the present embodiment, all of the inkjet heads 21 are provided to discharge white ink therefrom, and the first ink cartridges 31 respectively contain white ink.

The ink conveyer tubes 34 to supply the white ink to the first inkjet heads 21 are moved along with first inkjet heads 21 when the carriage 13 with the first inkjet heads 21 is reciprocated in the main scanning direction. Therefore, the ink conveyer tubes 34 are formed to be longer than a length of the guide rail 11. The ink conveyer tubes 34 with the length are held by a first arm 36 to extend there-along so that the ink conveyer tubes 34 can smoothly move to follow the carriage 13.

The first arm 36 includes a rear portion 36D, which is a thin and elongated plate rotatable about a supporting point 36A, and a supporting point 36B is provided at an end of the rear portion 36D. The first arm 36 further includes a front portion 36E, which is a thin and elongated plate rotatable about the supporting point 36B and is coupled to the carriage 13 at a supporting point 36C.

The inkjet printer 1 according to the present embodiment is equipped with a guide rail 12, which is arranged in parallel with the guide rail 11, to guide a carriage 14 with second inkjet heads 22 being mounted. As shown in FIG. 2, the guide rail 12 is arranged in a position higher than the guide rail 11.

In the vicinity of the left-hand end of the guide rail 12, a second carriage motor 25 (FIG. 6) to carry the second inkjet heads 22 is provided. Further, a pulley (not shown) is provided in the vicinity of the right-hand end of the guide rail 12, and a carriage belt (not shown) is drawn between the second carriage motor 25 and the pulley. The carriage belt is fixed to the carriage 14 so that the carriage 14 is reciprocated along the guide rail 12 in the left-and-right direction (i.e., the main scanning direction) when the second carriage motor 25 is activated.

On the left-hand end of the chassis 10, second ink cartridges 32 containing CMYK (cyan, magenta, yellow, and black) colored inks respectively therein are detachably attached. The second ink cartridges 32 are connected to each of the inkjet heads 22 by flexible ink conveyer tubes 35 so that the inks stored in the second ink cartridges 32 are conveyed to each channel of the inkjet heads 22. According to the present embodiment, each of the inkjet heads 22 discharges C, M, Y, K ink therefrom respectively.

The ink conveyer tubes 35 to supply the ink to the second inkjet heads 22 are moved along with second inkjet heads 22 when the carriage 14 with the second inkjet heads 22 is reciprocated in the main scanning direction. Therefore, the ink conveyer tubes 35 are formed to be longer than a length of the guide rail 12. The ink conveyer tubes 35 with the length are held by a second arm 37 to extend there-along so that the ink conveyer tubes 35 can smoothly move to follow the carriage 14.

The second arm 37 includes a rear portion 37D, which is a thin and elongated plate, rotatable about a supporting point 37A, and a supporting point 37B is provided at an end of the rear portion 37D. The second arm 37 further includes a front portion 37E, which is a thin and elongated plate, rotatable about the supporting point 37B and is coupled to the carriage 14 at a supporting point 37C.

At right-hand front of the inkjet printer 1 is provided an operation panel 28, through which a user inputs an instruction to manipulate the inkjet printer 1. The operation panel 28 includes operation buttons 29 and a display 30 including an LCD (liquid crystal display).

The first inkjet heads 21 will be described with reference to FIG. 3. As has been mentioned above; the first ink conveyer tubes 34 connect the first ink cartridges 31 storing the white ink and the channels of the first recording heads 21 to eject the white ink.

Each of the first inkjet heads 21 includes a damper case 50, a base plate 62, and an inkjet nozzle 60. The base plate 62 is formed to have screw holes 64 (see FIG. 4) in the vicinities of the front end and the rear end thereof and is fasten to the carriage 13 with screws (not shown) screwed in the screw holes 64. The damper case 50 is an upright hexahedron case, in which the white ink to be conveyed from the first ink cartridge 31 to the inkjet nozzle 60 is reserved. The damper case 50 is formed to have a flange portion 63 at a bottom thereof, and the base plate 62 intervenes between the flange portion 63 and the inkjet nozzle 60. The inkjet nozzle 60 is a hexahedron-shaped piece, which is fixed to a lower portion of the base plate 62 with screws (not shown). The ink reserved in the damper case 50 is ejected out of the ink jet nozzle 60.

Thus, the first inkjet heads 21 and the first ink cartridges 31 are connected through the ink conveyer tubes 34, and the ink in the first ink cartridges 31 is supplied to the damper cases 50. According to the above configuration, the first ink cartridges 31 can be installed in the inkjet printer 1 in a user's accessible positions, in which no longer usable first ink cartridges 31 can be easily removed and replaced with new first ink cartridges 31.

Next, the first inkjet head 21 will be described specifically in detail with reference to FIGS. 4 and 5. According to the present embodiment, the second inkjet heads 22 have substantially identical structures with the first inkjet heads 21; therefore, description of the second inkjet heads 22 will be represented by that of the first inkjet heads 21.

The damper case 50 of the first inkjet head 21 is formed to have an ink inlet 54, an ink guide 59, a first ink chamber 51, a wall 56, a right side cover 57, a left side cover 58, a through hole 53, a second ink chamber 52, and an ink outlet 55.

The ink inlet 54 provides an opening, through which the ink conveyed in the ink conveyer tube 34 is introduced, and one end of the ink conveyer tube 34 is connected to the ink inlet 54. The ink introduced through the ink inlet 54 is guided along the ink guide 59. The ink guide 59 is a wall drooping downward in the first ink chamber 51 and guides the ink to flow in the first ink chamber 51. The first ink chamber 51 is a reservoir of the ink flowing in the damper case 50 along the ink guide 59. The ink guide 59 is formed to have a lower end thereof to be in a position lower than a top edge of the wall 56 so that the ink flowing along the ink guide 59 can be steadily led to the first ink chamber 51. Accordingly, spattering and bubbling of the ink in the first ink chamber 51 can be reduced.

The wall 56 arises upward from a bottom of an ink reservoir 61, which includes the first ink chamber 51 and the second ink chamber 52. The wall 56 has a height to leave an opening above the top edge thereof so that the first ink chamber 51 and the second ink chamber are in fluid communication over the top edge. The wall 56 extends perpendicularly to the reciprocating direction of the carriage 13. When the carriage 13 with the ink reservoir 61 is reciprocated, the ink in the ink reservoir 61 is ruffled in the direction perpendicular to the reciprocating direction of the carriage 13. Therefore, when the ink reservoir 61 is divided into the first ink chamber 51 and the second ink chamber 52, rippling and bubbling in the ink during the reciprocation is limited to the widthwise lengths of the first ink chamber 51 and the second ink chamber 52. Thus, the wall 56 reduces bubbling in the ink in the first ink chamber 51 and the second ink chamber 52 when the carriage 13 is reciprocated.

The right side cover 57 and the left side cover 58 are flexible films which cover the side walls, extending perpendicularly to the reciprocating direction of the carriage 13, of the damper case 50. Therefore, the right side cover 57 and the left side cover 58 extended along the side walls of the damper case can provide damper performance and absorb the pressure fluctuation, which occurs during the carriage reciprocation.

The through hole 53 allows the colorant deposited in the first ink chamber 51 to flow into the second ink chamber 52, which stores the flowed ink. The ink outlet 55 allows the ink stored in the second ink chamber 52 to flow to the inkjet nozzle 60.

Next, referring to FIG. 6, an electrical configuration of the inkjet printer 1 will be described. As shown in FIG. 6, the inkjet printer 1 is provided with a control unit 100, and the control unit 100 includes a CPU 110 that controls the entire operation in the inkjet printer 1. The CPU 110 is connected with a ROM 120 and a RAM 130 through a bus 115. The ROM 120 stores various controlling programs to be executed in the CPU 110. The RAM 130 temporarily stores data concerning the operations in the inkjet printer 1.

The CPU 110 is further connected with a communication unit 150 and with a PC (personal computer) 170 through a communication cable 160. Furthermore, the CPU 110 is connected with a print control unit 140 to control printing operations in the inkjet printer 1 through the bus 115. The print control unit 140 includes a head controller 141, a head drive controller 142, a platen feed motor controller 143, a sensor input unit 144, a display controller 146, and a maintenance controller 147.

The head controller 141 drives piezoelectric actuators for each of the channels in the first recording heads 21 and the second recording heads 22. The head drive controller 142 activates the first carriage motor 24 and the second carriage motor 25, and the platen feed motor controller 143 activates the platen feed motor 40.

The sensor input unit 144 receives signals provided from the operation buttons 29 included in the operation panel 28 and a cartridge detective sensors 43. The display controller 146 controls the display 30 included in the operation panel 28.

The inkjet printer 1 in the present embedment includes a first maintenance mechanism and a second maintenance mechanism respectively on either (right or left) side of the guide rail 11 and the guide rail 12. The first and the second maintenance mechanisms serve to maintain operating conditions of the first inkjet heads 21 and the second inkjet heads 22 respectively. The first maintenance mechanism includes a first maintenance motor 41, and the second maintenance mechanism includes a second maintenance motor 42. The print control unit 140 is provided with a maintenance controller 147 to activate the first maintenance motor 41 and the second maintenance motor 42.

Next, a flow of the ink in the first ink chamber 51 and the second ink chamber 52 will be described with reference to FIGS. 7 and 8.

As indicated by an arrow in FIG. 7, once injected through the ink inlet 54, the ink flows down to the bottom of the first ink chamber 51 and fills the first ink chamber 51 up to a level equivalent to the upper edge of the wall 56. Further, the ink flows over the upper edge of the wall 56 and into the second ink chamber 52. Thus, the first ink chamber 51 and the second ink chamber 52 are filled with the ink, as shown in FIG. 8.

When the inkjet printer 1 executes a printing operation and the ink is ejected from the inkjet nozzle 60, negative pressure is generated in the ink path in the ink reservoir 61. Accordingly, the ink in the second ink chamber 52 is led to ink outlet 55 and to the inkjet nozzle 60. Further, the ink in the first ink chamber 51 is moved over the wall 56 to the second ink chamber 52. Furthermore, the ink in the ink conveyer tube 34 (FIG. 3) is conveyed to the first ink chamber 51 through the ink inlet 54, and the ink in the first ink cartridge 31 (FIG. 1) flows into the ink conveyer tube 34. Thus, the ink in the first ink cartridge 31 is carried to the inkjet nozzle 60 by the negative pressure.

It has been known, heretofore, that white ink containing colorant with higher specific gravity is likely to accumulate in a container. In the present embodiment, specifically, the white ink may accumulate in the first ink chamber 51. Therefore, if the ink reservoir 61 is not provided with an ink path to allow the ink flow from the first ink chamber 51 to the second ink chamber 52, the colorant easily accumulates in the first ink chamber 51. If the wall 56 is formed to have a through hole, which is the through hole 53 in the present embodiment, the sediment (e.g., the oxidized titanium) in the first ink chamber 51 is carried from the first ink chamber 51 to the second ink chamber 52 through the through hole 53. The sediment carried to the second ink chamber 52 is further carried and discharged out of the second ink chamber 52 through the ink outlet 55. Accordingly, the first inkjet heads 21 and the second inkjet heads 22 can prevent the sediment from being accumulated in the first ink chambers 51. In this regard, when the through hole 53 is formed at an end portion of the wall 56 opposite from the ink inlet 54 in the extending direction of the wall 56, the sediment in the first ink chamber 51 can be effectively carried to the second ink chamber 52. Further, the sediment can be carried even more effectively when the through hole 53 is formed in a lower position adjoining the bottom of the first ink chamber 51. In order to prevent the through hole 53 from being obstructed by the sediment, the through hole 53 should be formed to have a diameter larger than, or at least equivalent to, a diameter of largest disperse particles.

According to the first inkjet heads 21 described above, the right side cover 57 and the left side cover 58 are flexible films to absorb the pressure fluctuation generated during the reciprocating operation of the carriage 13. When the sediment accumulates in the first ink chamber 51, however, a usable area of the pressure-absorbable surface of the right side cover 57 is partially or mostly occupied by the sediment, and the damper performance of the right side cover 57 can be lowered. Thus, the quality of ink ejection may be deteriorated. With the through hole 53 formed in the wall 56, therefore, the sediment of the colorant can be reduced, and the quality of ink ejection can be maintained.

Next, evaluations to verify an effective diameter of the through hole 53 and a preferable numerical quantity of through holes 53 to be formed in the wall 56 will be described.

Evaluation 1

In the first evaluation, firstly, eleven (11) samples of the first inkjet head 21 having different diameters and numerical quantity of through holes 53 were prepared (see Table 1 below). An eleventh sample (Sample #11) is a conventional inkjet head for comparison having no through hole 53 formed in the wall 56.

The inkjet head 21 of Sample #1 is formed to have a single through hole 53 with a diameter of 0.05 cm. The inkjet head 21 of Sample #2 is formed to have a single through hole 53 with a diameter of 0.08 cm. The inkjet head 21 of Sample #3 is formed to have a single through hole 53 with a diameter of 0.10 cm. The inkjet head 21 of Sample #4 is formed to have a single through hole 53 with a diameter of 0.12 cm. The inkjet head 21 of Sample #5 is formed to have a single through hole 53 with a diameter of 0.15 cm. The inkjet head 21 of Sample #6 is formed to have nine (9) through holes 53 with a diameter of 0.10 cm. The inkjet head 21 of Sample #7 is formed to have a single through hole 53 with a diameter of 0.20 cm. The inkjet head 21 of Sample #8 is formed to have four (4) through holes 53 with a diameter of 0.15 cm. The inkjet head 21 of Sample #9 is formed to have a single through hole 53 with a diameter of 0.25 cm. The inkjet head 21 of Sample #10 is formed to have a single through hole 53 with a diameter of 0.30 cm. The inkjet head 21 of Sample #11 is provided with a conventional damper case having no through hole 53.

Secondly, flow path resistances at the through holes 53 of Samples #1-#11 were calculated. The flow path resistance refers to resistance of fluid generated in a flow path (i.e., the through hole 53). A value indicating the flow path resistance (R) is obtained in the following formula:

$$R = 8 * \text{ink viscosity} * \text{length of the flow path} / (\text{equivalent radius})^2 / \text{cross-sectional area of the flow path}$$

The equivalent radius is obtained in the following formula:

$$\text{Equivalent radius} = 2 * \text{cross-section of the flow path} / \text{wetting circumferential length}$$

The wetting circumferential length is a length of a circumference exposed to the flowing fluid. When the cross-section of the flow path has a shape of a circle with a radius r, the wetting circumferential length is $2\pi r$.

The length of the flow path is unified to 0.18, which is a thickness of the wall 56, in all Samples #1-#11. The ink viscosity is 1 mPa·s, which is common to all Samples #1-#11. Based on these figures, the flow path resistances were obtained, and the flow path resistance ratios as indicated in the rightmost column in Table 1 were obtained. The flow path resistance ratios in the rightmost column indicate ratios of the flow path resistances at the through holes 53 of Samples #1-#11 whereas the flow path resistance Ri in the first ink chambers 51 is considered to be 1. The value of the flow path resistance Ri in the first ink chamber 51 is 1008 (Ri=1008).

Thirdly, an experiment as described below was conducted to each of Samples #1-#11: The white ink with the colorant of oxidized titanium is injected in the first ink chamber 51 of the damper case 50. Further, it is attempted to fill the second ink

TABLE 1

| Sample # | Diameter (unit: cm) | Quantity | Radius (r) (unit: cm) | Length (l) (unit: cm) | Cross-section (S) (unit: $cm^2$) | Flow path resistance (R) (unit: Pa · s/$cm^3$) | Flow path resistance ratio |
|---|---|---|---|---|---|---|---|
| 1 | 0.05 | 1 | 0.025 | 0.18 | 0.00196 | 1173418 | 1165:1 |
| 2 | 0.08 | 1 | 0.040 | 0.18 | 0.00503 | 179049 | 178:1 |
| 3 | 0.10 | 1 | 0.050 | 0.18 | 0.00785 | 73339 | 73:1 |
| 4 | 0.12 | 1 | 0.060 | 0.18 | 0.01131 | 35368 | 35:1 |
| 5 | 0.15 | 1 | 0.075 | 0.18 | 0.01767 | 14487 | 14:1 |
| 6 | 0.10 | 9 | 0.050 | 0.18 | 0.07069 | 8149 | 8:1 |
| 7 | 0.20 | 1 | 0.100 | 0.18 | 0.03142 | 4584 | 5:1 |
| 8 | 0.15 | 4 | 0.075 | 0.18 | 0.07069 | 3622 | 4:1 |
| 9 | 0.25 | 1 | 0.125 | 0.18 | 0.04909 | 1877 | 2:1 |
| 10 | 0.30 | 1 | 0.150 | 0.18 | 0.07069 | 905 | 1:1 |
| 11 | no hole | 0 | — | — | — | — | — |

chamber 52 as well as the first ink chamber 51 up to the level of the upper edge of the wall 56 (see FIG. 8) in a predetermined ink loading procedure. In the ink loading procedure, a purge-aspiration pump is attached to the inkjet nozzle 60, and the pump is activated for a predetermined period of time so that the ink is drawn from the first ink chamber 51 to the second ink chamber 52 by negative pressure caused by the pump.

When the diameter of the through hole 53 in the wall 56 is larger and the flow path resistance is smaller, the ink in the first ink chamber 51 is drawn to the second ink chamber 52 solely through the through hole 53 and does not flow over the wall 56. Accordingly, the ink reservoir 61 is not filled up to a substantial level within the predetermined period. Amounts of the ink loaded in the ink reservoir 61 are obtained after the ink loading procedure, and results are indicated in Table 2 appearing below. In a column second to the left in Table 2, evaluation of the amount of the loaded ink indicated. In this regard, when a filling rate of the ink loaded in the ink reservoir 61 is on or over 80%, it is evaluated to be "excellent." When the filling rate is on or over 60% and smaller than 80%, it is evaluated to be "fair." When the filling rate is smaller than 60%, it is evaluated to be "poor." In the present embodiment, the samples with judgments "excellent" and "fair" are determined to be acceptable.

As a consequence, Samples #1-#4 and #11 indicated the filling rate of 100% (excellent), whilst Sample #5 indicated on or over 60% and smaller than 80% (fair). Samples #6-#10 indicated smaller than 60% (poor). Therefore, it is noted that Sample #5 can fill 60% or more of the ink reservoir 61 with the smallest flow path resistance ratio, which is 14:1.

Evaluation 2

After the experiment in Evaluation 1, the inkjet heads 21 of Samples #1-#11 were left unused for one week. Thereafter, the ink is loaded in the ink reservoir 61 to find a flushing ability of the ink to remove the sediment from the ink reservoir 61. Amounts of the remaining sediment after flushing are evaluated, and the evaluation is indicated in a column second to the right in Table 2. In this regard, when no remaining sediment is visually recognized in the first ink chamber 51, it is evaluated to be "excellent." When the visually recognized sediment remains in the first ink chamber 51, it is evaluated to be "poor." A bar (–) in the second to right column indicates that no evaluation was made to the sample.

As shown in Table 2, it is noted that Sample #11 without the through hole 53 indicates "poor" flushing ability, and the other evaluated samples indicate "excellent" flushing ability.

TABLE 2

| Sample # | Ink filling rate | Flushing ability | Flow path resistance ratio |
|---|---|---|---|
| 1 | excellent | excellent | 1165:1 |
| 2 | excellent | excellent | 178:1 |
| 3 | excellent | excellent | 73:1 |
| 4 | excellent | excellent | 35:1 |
| 5 | fair | excellent | 14:1 |
| 6 | poor | excellent | 8:1 |
| 7 | poor | — | 5:1 |
| 8 | poor | excellent | 4:1 |
| 9 | poor | — | 2:1 |
| 10 | poor | — | 1:1 |
| 11 | excellent | poor | — |

According to the above Evaluations 1 and 2, it is noted that Sample #5 clears the acceptable criteria of the ink filling rate at the smallest flow path resistance value (i.e., the possible largest diameter) and the flushing ability to flush the sediment after the predetermined unused period. The flow path resistance ratio of Sample #5 is 14:1. In other words, when the ratio of the flow path resistance value at the through hole 53 in the wall 56 to the flow path resistance value in the first ink chamber 51 is 14:1 or larger, the ink can be acceptably loaded in the ink reservoir 61 and the sediment does not substantially remain in the first ink chamber 51. Therefore, sufficient damper performance of the ink reservoir 61 can be maintained. Specifically, when a sufficient amount of ink is loaded in the ink reservoir 61, it is preferable that the ratio of the flow path resistance value at the through hole 53 to the flow path resistance value in the first ink chamber 51 is to be set to 35:1 or larger.

Although an example of carrying out the invention has been described, those skilled in the art will appreciate that there are numerous variations and permutations of the inkjet head and the inkjet printing apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the inkjet head may have a filter to cover a through hole formed in the wall 56 so that the ink flows through the through hole is filtered. FIG. 9 illustrates a side view of an inkjet head 201 with a horizontally elongated through hole 71 and a filter 72. The filter 72 can catch unexpected larger objects in the ink flowing from the first ink chamber 51 to the second ink chamber 52 and prevents the objects from flowing into the inkjet nozzle 60. In this configuration, the elongated through hole 71 is formed to have the flow path resistance ratio of the filtered ink flowing through the elongated through hole 71 with the filter 72 to the first ink chamber 51 to be 14:1. A shape of the through hole 71 is not limited to the horizontally elongated ellipse as long as the through hole provides equivalent fluidity.

For another example, a bottom surface of the first ink chamber 51 can be declined in order to improve fluidity of the ink flowing from the ink chamber 51 to the second ink chamber 52. FIG. 10 illustrates a cross-sectional view of an inkjet head 211 with a bottom surface 67 in the first ink chamber 51 declined toward the wall 56. The declination of the bottom surface 67 improves the fluidity of the sediment as well as the fluidity of the ink flowing from the first ink chamber 51 to the second ink chamber 52. Therefore, the amount of the sediment remaining in the first ink chamber 51 can be reduced.

Further, the inkjet head may have a plurality of through holes formed in the wall 56. FIG. 11 illustrates a side view an inkjet head 221 having a plurality of through holes 81, 82, 83 in the wall 56. With the plurality of through holes 81, 82, 83, when one of the through holes 81, 82, 83 (e.g., the through hole 81) catches a larger foreign object and obstructed, the remaining through holes 82, 83 continue to allow the ink and the sediment to flow from the first ink chamber 51 to the second ink chamber 52. In this configuration, the through holes 81, 82, 83 are formed to have the entire flow path resistance ratio to the first ink chamber 51 to be 14:1.

Furthermore, the inkjet head may have a plurality of walls extending in parallel with one another in the ink reservoir 61. FIG. 12 illustrates a cross-sectional view of an inkjet head 231 with a first wall 68 and a second wall 69. The first wall 68 and the second wall 69 arise upward from a bottom of an ink reservoir 91, which includes a first ink chamber 91, a second ink chamber 92, and a third ink chamber 93. FIG. 13 illustrates a cross-sectional view of the inkjet head 231, taken at a line B-B indicated in FIG. 12. When the ink reservoir 61 is divided into the three ink chambers by the walls 68, 69, the first ink chamber 91, the second ink chamber 92, and the third ink chamber 93 are formed to have widthwise lengths thereof to be smaller than width wise lengths of the first ink chamber 51 and the second ink chamber 52. Therefore, bubbling in the ink in each ink chamber during the reciprocating movement of the carriage 13 is reduced more effectively, and the ink-ejecting quality of the inkjet head 231 can be even more effectively improved.

The first wall 68 and the second wall 69 are respectively formed to have a first through hole 95 and a second through hole 96 in the vicinities of the bottom of the ink reservoir 94. The first through hole 95 at an upper-stream side with respect to the ink flow is formed at an end further from the ink inlet 54. The second through hole 96 at a lower-stream side with respect to the ink flow is formed at an end further from the first through hole 95 and closer to the ink inlet 54. In other words, the first through hole 95 and the second through hole 96 are in positions to be away from each other alternately within the ink reservoir 94 in front-rear direction in order to maintain fluidity in the ink chambers 91, 92, 93. Thus, accumulation of the sediment in each ink chamber can be effectively prevented.

In the above embodiments, the inkjet head is used in the inkjet printer 1, which is to print an image on a piece of fabric being the recording medium. However, the present invention can be similarly applied to an inkjet printer which is capable of printing an image on a sheet of paper and other recording medium, in place of a piece of fabric, in inks. Moreover, the present invention can be effectively applied to an ink applying apparatus, which ejects, for example, ultraviolet curable ink or other ultraviolet curable agent (e.g., foundation coat and overcoat) to surfaces of an object.

What is claimed is:

1. An inkjet head having an ink nozzle capable of ejecting ink onto a recording medium, comprising:

an ink reservoir to store the ink to be ejected therein, the ink reservoir comprising a wall extending from a bottom of the ink reservoir to divide the ink reservoir into a first ink chamber and a second ink chamber, the first and the second ink chambers being in fluid communication with each other over a top edge of the wall, the wall including a through hole formed in a vicinity of the bottom of the ink reservoir, the through hole allowing the first and the second ink chambers to be in fluid communication with each other;

an ink inlet, through which the ink is introduced into the ink reservoir, the ink inlet introducing the ink into the first ink chamber; and an ink outlet, through which the ink in the ink reservoir is allowed to flow to the ink nozzle, the ink outlet discharging the ink in the second ink chamber to the ink nozzle, wherein a ratio of a flow path resistance value of the ink at the through hole to a flow path resistance value of the ink in the first ink chamber is at least 14:1.

2. The inkjet head according to claim 1, wherein the through hole in the wall is formed in a position adjoining the bottom of the ink reservoir.

3. The inkjet head according to claim 1, wherein the through hole is formed at an end portion of the wall opposite from the ink inlet.

4. The inkjet head according to claim 1, wherein the first ink chamber includes a droop wall, which extends downward from the ink inlet in a direction of an ink flow; and the droop wall has a lower end thereof to be in a position lower than the top edge of the wall.

5. The inkjet head according to claim 1, wherein a diameter of the through hole is larger than a diameter of a largest particle in the ink.

6. The inkjet head according to claim 1, wherein the first ink chamber has a bottom surface declined toward the wall.

7. The inkjet head according to claim 1, wherein the wall has a plurality of through holes.

8. The inkjet head according to claim 1, wherein the through hole is covered with a filter so that the ink flowing through the through hole is filtered; and a ratio of a flow path resistance value of the filtered ink at the through hole to a flow path resistance value of the ink in the first ink chamber is at least 14:1.

9. The inkjet head according to claim 1, wherein the inkjet head is mounted on a carriage; and the wall extends within the ink reservoir in a direction perpendicular to a moving direction of the carriage.

10. The inkjet head according to claim 9, wherein the ink reservoir is provided with a plurality of walls, each of the walls extending from the bottom of the ink reservoir to divide the ink reservoir into a plurality of ink chambers, each of the walls having a through hole;

each of the plurality of walls extend within the ink reservoir in the direction perpendicular to the moving direction of the carriage;

the through hole of a first wall that is among the plurality of walls is formed at an end portion of the first wall opposite from the ink inlet, the first wall being provided in a most upstream position with respect to a flow of the ink and closest to the ink inlet; and the through hole of a lower-side wall, which is among the plurality of walls and is situated in a lower-stream side of the ink flow, is at an end portion thereof opposite from the through hole formed in an adjoining upper-side wall, which is among the plurality of walls and is situated in an upper-stream side of the ink flow.

11. An inkjet printing apparatus comprising an inkjet head with an ink nozzle capable of ejecting ink onto a recording medium, wherein the inkjet head includes:

an ink reservoir to store the ink to be ejected therein, the ink reservoir comprising a wall extending from a bottom of the ink reservoir to divide the ink reservoir into a first ink chamber and a second ink chamber, the first and the second ink chambers being in fluid communication with each other over a top edge of the wall, the wall including a through hole formed in a vicinity of the bottom of the ink reservoir, the through hole allowing the first and the second ink chambers to be in fluid communication with each other;

an ink inlet, through which the ink is introduced into the ink reservoir, the ink inlet introducing the ink into the first ink chamber; and an ink outlet, through which the ink in the ink reservoir is allowed to flow to the ink nozzle, the ink outlet discharging the ink in the second ink chamber to the ink nozzle: and wherein a ratio of a flow path resistance value of the ink at the through hole to a flow path resistance value of the ink in the first ink chamber is at least 14:1.

12. The inkjet printing apparatus according to claim 11, further comprising:

a fixed ink container, which contains the ink to be supplied to the inkjet head therein, wherein the ink reservoir of the inkjet head and the fixed ink container are connected with an ink conveying tube.

13. The inkjet head according to claim 11,
wherein the through hole in the wall is formed in a position adjoining the bottom of the ink reservoir.

14. The inkjet head according to claim 11,
wherein the through hole is formed at an end portion of the wall opposite from the ink inlet.

15. The inkjet head according to claim 11, wherein
the first ink chamber includes a droop wall, which extends downward from the ink inlet in a direction of an ink flow; and
the droop wall has a lower end thereof to be in a position lower than the top edge of the wall.

16. The inkjet head according to claim 11,
wherein a diameter of the through hole is larger than a diameter of a largest particle in the ink.

17. The inkjet head according to claim 11,
wherein the first ink chamber has a bottom surface declined toward the wall.

18. The inkjet head according to claim 11,
wherein the wall has a plurality of the through holes.

19. The inkjet head according to claim 11, wherein
the through hole is covered with a filter so that the ink flowing through the through hole is filtered; and
a ratio of a flow path resistance value of the filtered ink at the through hole to a flow path resistance value of the ink in the first ink chamber is at least 14:1.

20. The inkjet head according to claim 11, wherein
the inkjet head is mounted on a carriage; and
the wall extends within the ink reservoir in a direction perpendicular to a moving direction of the carriage.

21. The inkjet head according to claim 20, wherein
the ink reservoir is provided with a plurality of walls, each of the walls extending from the bottom of the ink reservoir to divide the ink reservoir into a plurality of ink chambers, each of the walls having a through hole;
each of the plurality of walls extend within the ink reservoir in the direction perpendicular to the moving direction of the carriage;
the through hole of a first wall that is among the plurality of walls is formed at an end portion of the wall opposite from the ink inlet, the first wall being provided in a most upstream position with respect to a flow of the ink and closest to the ink inlet; and
the through hole of a lower-side wall, which is among the plurality of walls and is situated in a lower-stream side of the ink flow, is at an end portion thereof opposite from the through hole formed in an adjoining upper-side wall, which is among the plurality of walls and is situated in an upper-stream side of the ink flow.

* * * * *